US011613388B2

(12) United States Patent
Hamilton

(10) Patent No.: US 11,613,388 B2
(45) Date of Patent: Mar. 28, 2023

(54) METHOD AND APPARATUS FOR SIPHONING A BEVERAGE INTO A FLEXIBLE CONTAINER

(71) Applicant: Fermtech Ltd., Kitchener (CA)

(72) Inventor: Derek Hamilton, Waterloo (CA)

(73) Assignee: Fermtech Ltd., Waterloo (CA)

( * ) Notice: Subject to any disclaimer, the term of this patent is extended or adjusted under 35 U.S.C. 154(b) by 163 days.

(21) Appl. No.: 17/231,123

(22) Filed: Apr. 15, 2021

(65) Prior Publication Data

US 2021/0362886 A1 Nov. 25, 2021

Related U.S. Application Data

(60) Provisional application No. 63/028,980, filed on May 22, 2020.

(51) Int. Cl.

| | |
|---|---|
| ***B65B 3/04*** | (2006.01) |
| ***B67D 3/00*** | (2006.01) |
| ***B65B 3/06*** | (2006.01) |

(52) U.S. Cl.

CPC ..... *B65B 3/045* (2013.01); *B65B 3/06* (2013.01); *B67D 3/0048* (2013.01); *B67D 3/0061* (2013.01)

(58) Field of Classification Search

CPC ..... B65B 3/045; B65B 3/06; B67D 3/0048; B67D 3/0061

See application file for complete search history.

(56) References Cited

U.S. PATENT DOCUMENTS

| | | | | |
|---|---|---|---|---|
| 3,265,254 | A | 8/1966 | Carter et al. | |
| 3,299,606 | A | 1/1967 | Weikert | |
| 3,491,803 | A | 1/1970 | Galik | |
| 3,946,780 | A | 3/1976 | Sellers | |
| 4,446,674 | A | 5/1984 | Inada | |
| 4,869,398 | A | 9/1989 | Colvin et al. | |
| 8,807,377 | B2 | 8/2014 | Corbett et al. | |
| 9,926,182 | B2 | 3/2018 | Santy | |
| 10,479,968 | B2 | 11/2019 | Novak | |
| 2006/0118574 | A1 | 6/2006 | Anderson et al. | |
| 2009/0159594 | A1* | 6/2009 | Nielsen | B67D 3/045 222/105 |
| 2009/0274793 | A1* | 11/2009 | Schroeder | C12H 1/16 426/8 |
| 2017/0225862 | A1* | 8/2017 | Schnabel | B65D 25/54 |

* cited by examiner

*Primary Examiner* — Jason K Niesz

(74) *Attorney, Agent, or Firm* — Bereskin & Parr LLP

(57) ABSTRACT

A method of filling a beverage bag. The beverage bag is part of a beverage container that also includes a rigid container housing supporting a dispensing spout of the beverage bag, the dispensing spout forming a dispensing passage from an interior of the beverage bag to an exterior of the beverage container for dispensing a content of the beverage bag. The method includes running a siphoning line from a beverage reservoir to the beverage bag, removing the dispensing tap, extending a siphon line outlet portion of the siphoning line into the beverage bag through the dispensing passage, sealing the dispensing spout around the siphon line outlet portion to prevent pressure release through the dispensing spout around the siphon line outlet portion, and siphoning the beverage from the beverage reservoir into the beverage bag to expand the beverage bag to fill inner dimensions of the rigid container housing.

20 Claims, 5 Drawing Sheets

METHOD AND APPARATUS FOR SIPHONING A BEVERAGE INTO A FLEXIBLE CONTAINER

CROSS-REFERENCE TO RELATED APPLICATION

This application claims the benefit of U.S. Provisional Patent Application No. 63/028,980, filed May 22, 2020, the contents of which are hereby incorporated by reference.

FIELD

The disclosure relates to siphoning a beverage, and in particular, to a method and apparatus for siphoning a non-carbonated beverage, such as wine, from a beverage reservoir into a flexible container, such as an oxygen barrier bag having a dispensing tap.

BACKGROUND

Many non-carbonated beverages are stored in a beverage reservoir for a time. For example, a non-carbonated beverage may be prepared in bulk and stored in a beverage reservoir until it is ready to be divided into smaller volumes. For example, a home beverage making process may involve preparing a non-carbonated beverage, such as wine, mead, or cider, in bulk in a beverage reservoir.

In many cases, a beverage stored in a beverage reservoir is transferred out of the beverage reservoir by gravity siphoning the beverage from the beverage reservoir. A beverage may be siphoned out of the beverage reservoir into a flexible container. For example, a beverage may be wine and may be siphoned out of a reservoir into an oxygen barrier bag.

Often, these oxygen barrier bags include a removable dispensing tap that fits in a rigid dispensing spout. Many users of home beverage systems buy a supply of beverage bags, remove the dispensing taps from the dispensing spouts of the beverage bags, and use gravity siphoning to siphon beverage from their reservoir into the beverage bags. However, gravity siphoning does not always result in the beverage bags being completely filled, especially when the bags are being filled while they are placed inside a rigid housing.

There is accordingly a need for improved methods and apparatus for siphoning a beverage from a beverage reservoir into a flexible container.

SUMMARY

According to a first aspect, there is provided a method of filling a beverage bag with a beverage, comprising running a siphoning line from a beverage reservoir to the beverage bag, wherein the beverage bag is part of a beverage container that also includes a rigid container housing supporting a dispensing spout of the beverage bag, the dispensing spout forming a dispensing passage from an interior of the beverage bag to an exterior of the beverage container for dispensing a content of the beverage bag; removing the dispensing tap from the beverage bag; extending a siphon line outlet portion of the siphoning line into the beverage bag through the dispensing passage; sealing the dispensing spout around the siphon line outlet portion to prevent pressure release through the dispensing spout around the siphon line outlet portion; siphoning the beverage, while the dispensing spout is sealed around the siphon line outlet portion, from the beverage reservoir into the beverage bag through the siphon line outlet portion to expand the beverage bag to fill inner dimensions of the rigid container housing; and withdrawing the siphon line outlet portion from the beverage bag once the beverage bag is expanded.

In some examples, the method further comprises forming an air pocket within the beverage bag adjacent the dispensing spout by extending the siphon line outlet portion into the beverage bag through the dispensing passage.

The rigid container housing may include a housing forming an enclosed chamber, and the beverage bag may be received in the enclosed chamber with the dispensing passage extending out of the enclosed chamber.

The method may comprise, after withdrawing the siphon line outlet portion from the beverage bag, blocking the dispensing passage with a dispensing tap.

The beverage may be wine and the beverage bag may include an oxygen barrier bag.

The beverage may be non-carbonated and the beverage bag may include an oxygen barrier bag.

The method may comprise, ahead of running the siphoning line from the beverage reservoir to the beverage bag positioning the beverage bag against an inner side of a first portion of the rigid container housing; and positioning at least one further portion of the rigid container housing over the beverage bag and securing the at least one further portion to the first portion to assembly the rigid container housing and enclose the dispensing spout therebetween to hold the dispensing spout.

The method may comprise topping up the beverage bag with beverage after withdrawing the siphon line outlet portion from the beverage bag.

A spacer tip may be included on the siphon line outlet portion adjacent an outlet opening of the siphon line outlet portion to prevent the outlet opening from being blocked by a wall of the beverage bag.

A tapered stopper may be included on the siphon line outlet portion for use in sealing the dispensing spout around the siphon line outlet portion.

The dispensing passage may extend out of a front side of the rigid container housing, and the rigid container housing may be rested on a back side opposite the front side while the beverage is siphoned from the beverage reservoir into the beverage bag through the siphon line outlet portion.

The method may further comprise waiting for the siphoning flow to automatically stop before withdrawing the siphon line outlet portion from the beverage bag According to a second aspect, there is provided a beverage siphoning system, comprising a beverage container, including a beverage bag having a dispensing spout forming a dispensing passage to an exterior of the beverage container and a dispensing tap configured to be removably fitted into the dispensing opening, wherein the container housing has an opening configured for supporting the dispensing spout; a siphon line having an inlet portion for receiving the beverage from a beverage reservoir and an outlet portion shaped to extend through the dispensing passage into the beverage bag and form an air pocket in the beverage bag adjacent the dispensing spout; and a sealing device shaped to close the dispensing spout, when the dispensing tap is removed from the beverage bag, to prevent pressure release through the dispensing spout around the siphon line outlet portion during siphoning, the sealing device having a bore shaped for receiving the outlet portion of the siphon line.

In some examples, the system further comprises a spacer tip securable to an end of the siphon line outlet portion adjacent an outlet opening of the siphon line outlet portion and shaped to fit through the dispensing spout while secured to the end of the siphon line outlet portion and prevent a wall of the flexible container from blocking the outlet opening.

The rigid container housing may include a housing forming an enclosed chamber having at least one interior corner, and the beverage bag may be received in the enclosed chamber with the dispensing passage extending out of the enclosed chamber.

The enclosed chamber may be a generally cuboid chamber.

The rigid container housing may include at least two portions releasably connected around the beverage bag to hold the beverage bag in the rigid container housing.

The at least two portions may be releasably connected by snap-fit connectors.

The sealing device may include a tapered stopper shaped to block the dispensing spout around the siphon line outlet portion.

The rigid container housing may include a viewing window in a wall of the rigid container housing and the beverage bag is formed of a transparent material to allow the user to view a content level of a content of the beverage bag through the viewing window and through the beverage bag.

The wall of the viewing window may be on a bottom side of the rigid container housing.

According to a third aspect, there is provided a beverage siphoning system for siphoning a beverage into a beverage bag from a beverage reservoir, the beverage bag having a dispensing spout forming a dispensing passage to an bag exterior of the beverage bag, the beverage siphoning system comprising a rigid container housing for housing the beverage bag, the rigid container housing having an opening configured for supporting the dispensing spout with the dispensing passage extending to a housing exterior of the rigid container housing; a siphon line having an inlet portion for receiving a beverage from a beverage reservoir and an outlet portion shaped to extend through the dispensing passage into the beverage bag, when the beverage bag is housed in the rigid container housing with the dispensing spout supported by the opening, and form an air pocket in the beverage bag adjacent the dispensing spout; and a sealing device shaped to close the dispensing spout to prevent pressure release through the dispensing spout around the siphon line outlet portion during siphoning, the sealing device having a bore shaped for receiving the outlet portion of the siphon line.

According to a fourth aspect, there is provided a beverage siphoning apparatus for siphoning a beverage into a beverage container comprising a rigid container housing for housing a beverage bag, the beverage bag having a dispensing spout forming a dispensing passage to an exterior of the beverage container and a dispensing tap configured to be removably fitted into the dispensing spout, wherein the container housing has an opening configured for supporting the dispensing spout, the siphoning apparatus comprising a siphon line having an inlet portion for receiving a beverage from a beverage reservoir and an outlet portion shaped to extend through the dispensing passage into the beverage bag and form an air pocket in the beverage bag adjacent the dispensing spout; and a sealing device shaped to close the dispensing spout, when the dispensing tap is removed from the beverage bag, to prevent pressure release through the dispensing spout around the siphon line outlet portion during siphoning, the sealing device having a bore shaped for receiving the outlet portion of the siphon line.

BRIEF DESCRIPTION OF THE DRAWINGS

The drawings included herewith are for illustrating various examples of systems, methods, and apparatus of the present specification. In the drawings.

DETAILED DESCRIPTION

Various apparatus or processes will be described below to provide an example of each claimed embodiment. No example described below limits any claimed embodiment and any claimed embodiment may cover processes or apparatuses that differ from those described below. The claimed embodiments are not limited to apparatuses or processes having all of the features of any one apparatus or process described below or to features common to multiple or all of the apparatus or processes described below.

The present inventor has determined that the aforesaid problem, namely, the incomplete filling of beverage bags, particularly those housed within a rigid housing, is due to the use of an open siphon, and that the problem can be solved by utilizing the methods and apparatus of the present invention.

Figure 1:
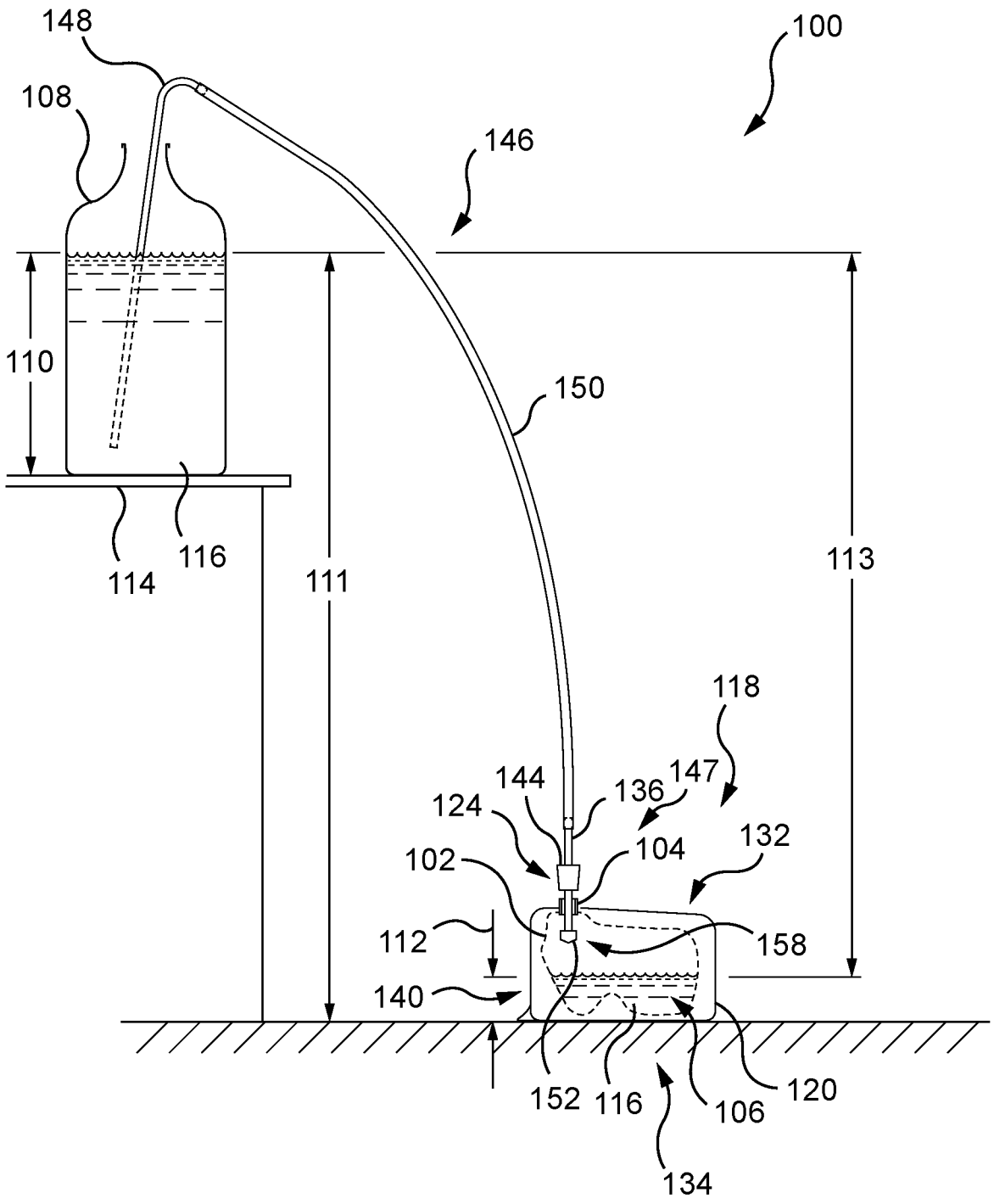
FIG. 1 is a cross sectional view of a beverage siphoning apparatus.

Referring now to FIG. 1, illustrated therein is a siphoning apparatus 147 for siphoning a non-carbonating beverage such as wine from a beverage reservoir 108 into a beverage bag 102. In the illustrated example, the beverage bag 102 is part of a beverage siphoning system 100.

Figure 2A:
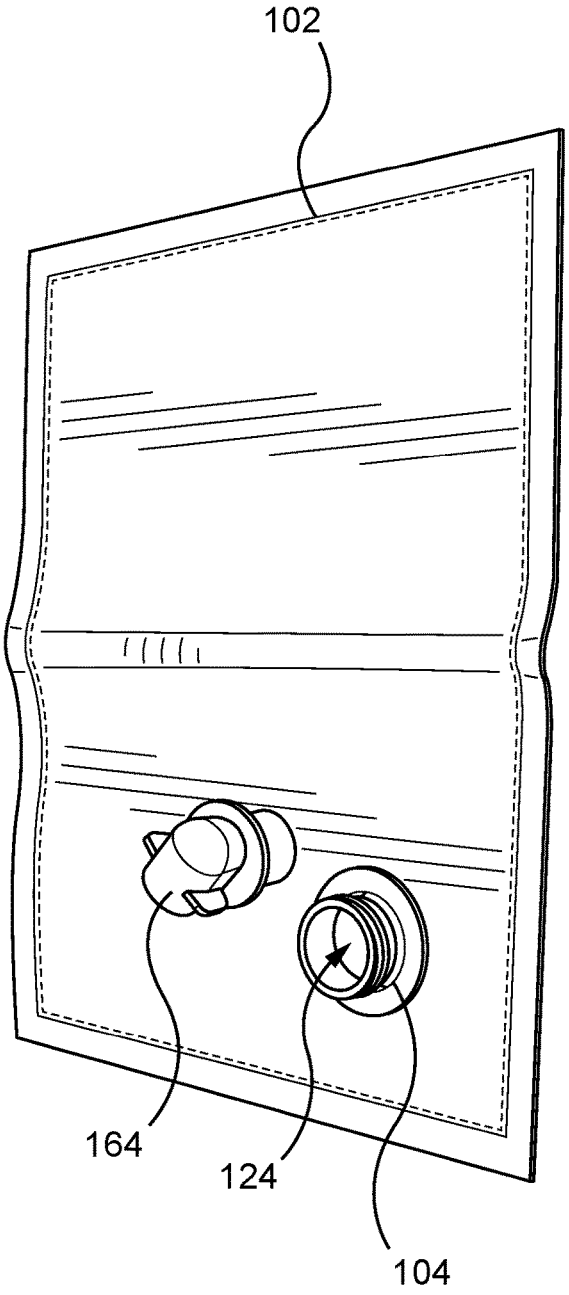
FIG. 2A is a perspective view of a beverage bag of the beverage siphoning apparatus of FIG. 1, with a dispensing tap removed from a dispensing spout.
Figure 2B:
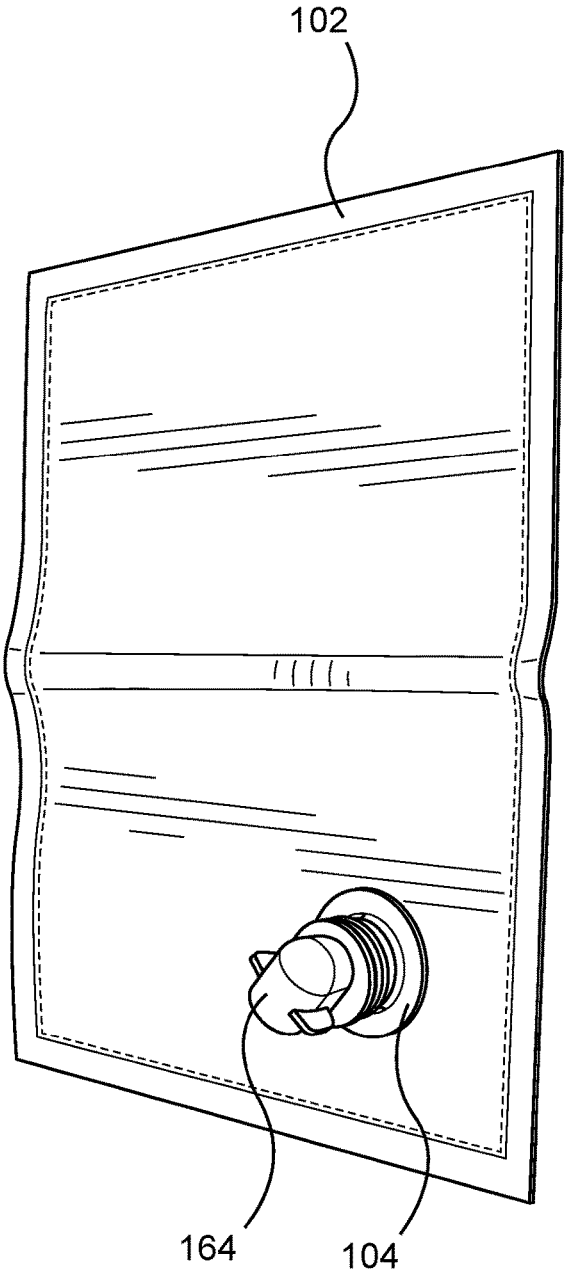
FIG. 2B is a perspective view of the beverage bag of FIG. 2A, with the dispensing tap received in the dispensing spout.

Referring now to FIGS. 2A and 2B, the beverage bag 102 includes a dispensing spout 104 for dispensing a content of the beverage bag 102. In some examples, the dispensing spout 104 forms a dispensing passage 124 from an interior 106 of the beverage bag 102 to an exterior of the beverage bag 102. In some examples, the dispensing spout 104 is a rigid plastic structure. In some examples, the beverage bag 102 includes a flexible plastic main body and the dispensing spout 104 is a rigid plastic structure. The illustrated dispensing spout 104 is formed of a hard plastic forming a rigid mouth for removably receiving a dispensing tap 164.

In some examples, the dispensing spout 104 is used to fill the beverage bag. In some examples, the dispensing spout 104 is used to fill the beverage bag using siphoning from a beverage reservoir 108, after the dispensing tap 164 is removed to open the dispensing passage 124.

Referring again to FIG. 1, the beverage reservoir 108 contains a beverage 116 used to fill the beverage bag 102. The beverage 116 may be wine, mead, or another non-carbonated beverage. In some examples, the beverage is wine.

The beverage reservoir 108 has a reservoir liquid level 110 that is above a flexible container liquid level 112 to facilitate siphoning. This hydraulic head 113 is a function of a reservoir liquid elevation 111 and the flexible container liquid level 112, and assists in driving beverage into the beverage bag 102 from the siphon line 146. In the illustrated example, the beverage reservoir 108 is an elevated reservoir positioned on an elevated surface 114.

The dispensing spout 104 is held in position during siphoning by a rigid structure. In some examples, the rigid structure holds the dispensing spout 104 in position after siphoning as well as during. In the illustrated example, the beverage bag 102 is part of a beverage container 118. The illustrated beverage container 118 includes a rigid container housing 120. The rigid container housing supports the dispensing spout 104 of the beverage bag. In some examples, the dispensing spout 104 forms the dispensing passage from the interior 106 of the beverage bag 102 to an exterior of the beverage container 118.

Figure 3:
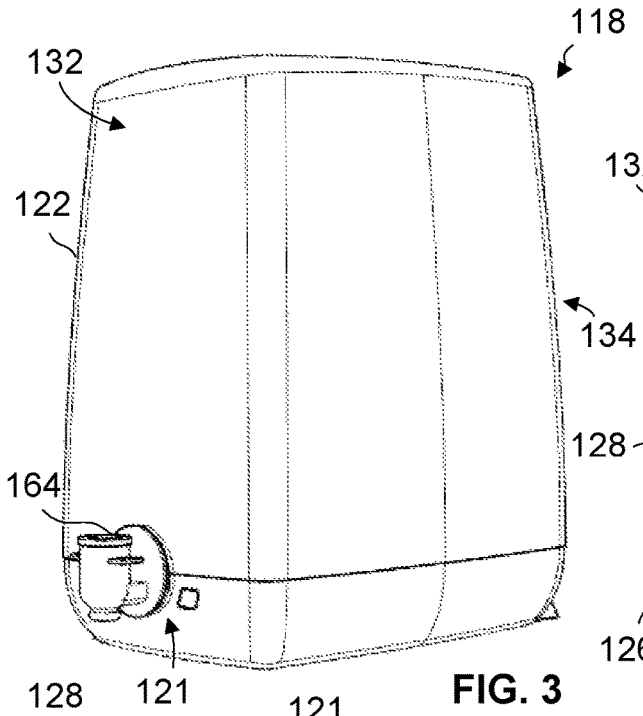
FIG. 3 is a front perspective view of a beverage container.

Reference is now made to FIG. 3. In some examples, the rigid container housing 120 is a simple structure for supporting the dispensing spout 104. However, in the illustrated example the rigid container housing 120 includes an enclosure housing 122 forming an enclosed generally cuboid chamber having corners at the top and bottom. The enclosure housing 122 is a rigid plastic structure. The beverage bag 102 is received in the enclosed chamber with the dispensing passage 124 extending out of the enclosed chamber. In some examples, receiving the beverage bag in an enclosed chamber protects the beverage bag 102 from damage. In some examples, receiving the beverage bag 102 in an enclosed chamber allows the beverage container 118 to be formed in an aesthetically pleasing way.

Figure 4:
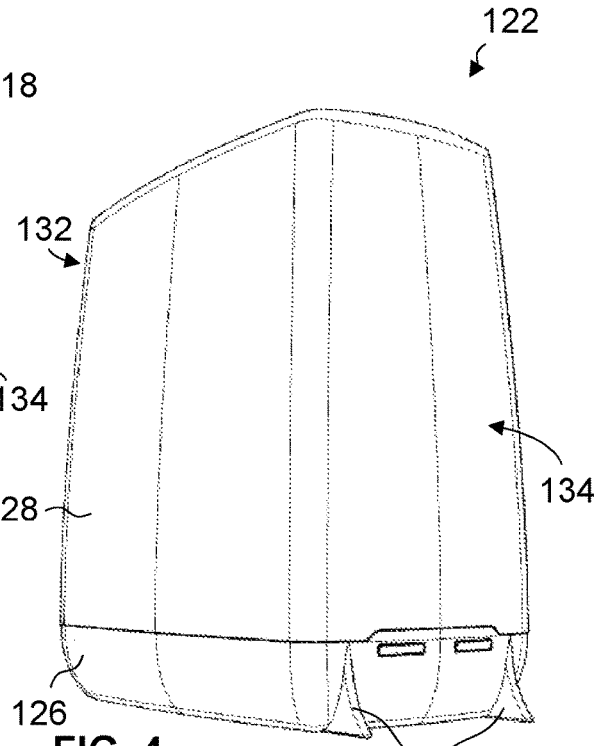
FIG. 4 is a back perspective view of the beverage container of FIG. 3.
Figure 5:
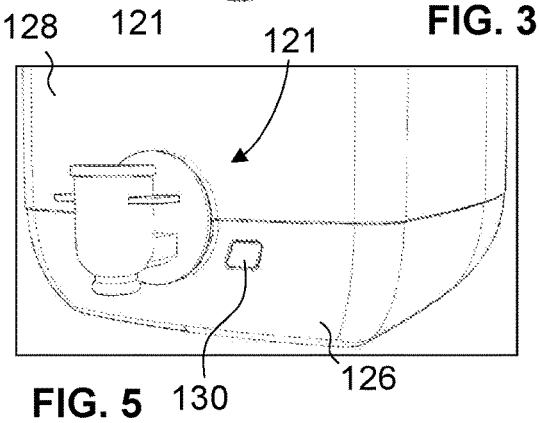
FIG. 5 is an expanded partial front perspective view of the beverage container of FIG. 3.
Figure 6:
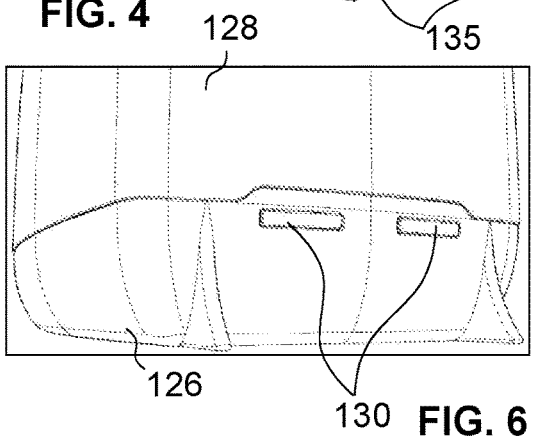
FIG. 6 is an expanded partial back perspective view of the beverage container of FIG. 3.

Referring now to FIGS. 4 to 6, the rigid container housing 120 is formed of a plurality of portions releasably secured together. In the illustrated example, the rigid container housing 120 is formed of a first portion 126 and a further portion 128. The first portion 126 and the further portion 128 are releasably secured together by mechanical fasteners 130. The illustrated mechanical fasteners 130 are snap-fit connectors.

The beverage bag 102 may be enclosed in the enclosure housing 122 by being positioned against an inner side of the first portion 126 and the further portion 128 positioned over the beverage bag 102. The first portion 126 and further portion 128 may be secured together to assemble the rigid container housing 120. In some examples, the first portion 126 and further portion 128 are secured together to enclose the dispensing spout 104 therebetween in the opening 121, the opening 121 partially formed by the first portion 126 and partially by the further portion 128. In some examples, the first portion 126 and the further portion 128 are secured together to enclose the beverage bag 102 within the rigid container housing 120 while the beverage bag 102 is empty.

Referring again to FIG. 3, the illustrated dispensing spout extends out of a front side 132 of the rigid container housing 120 and a dispensing tap 164 is received therein. The dispensing spout 104 extends out of a front side 132 of the rigid container housing 120 to allow a consumer easy access to the dispensing spout.

The rigid container housing 120 may be rested on a back side 134 opposite the front side 132 when the beverage 116 is siphoned from the beverage reservoir 108 into the beverage bag through a siphon line outlet portion 136. An example is shown in FIG. 1. Resting the rigid container housing 120 on the back side 134 during siphoning may provide the dispensing spout 104 at an upper end of the rotated rigid container housing 120 for ease of use.

Figure 7:
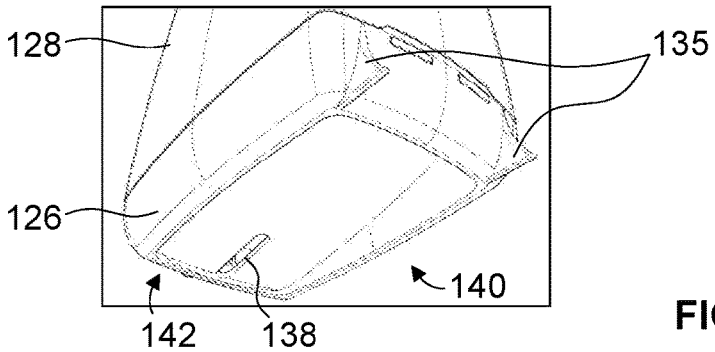
FIG. 7 is an expanded partial bottom perspective view of the beverage container of FIG. 3.

Referring to FIG. 7, a back side 134 of the rigid container housing 120 may include a curved surface, and one or more supports 135 provided to facilitate a stable resting position. In the illustrated example, the supports 135 are a pair of legs.

In some examples, a viewing window 138 is provided in a wall of the rigid container housing 120. In the illustrated example of FIG. 7, the viewing window 138 is provided in a bottom side 140 of the rigid container housing 120. The viewing window 138 in the bottom side 140 may allow a user to look through the viewing window 138 when the rigid container housing 120 is rotated onto the back side 134. In some examples, the viewing window 138 is at a forward end 142 of the bottom side 140 to be at an upper end during siphoning. The beverage bag 102 may be made of a transparent material to allow a user to view a level of a content of the beverage bag 102 through the viewing window 138 and through the beverage bag 102. In some examples, the viewing window allows a user to view the container liquid level 112.

Referring again to FIG. 1, the illustrated example beverage siphoning system 100 includes at least the beverage container 118 and a siphoning apparatus 147. The siphoning apparatus 147 includes the siphon line outlet portion 136, and a sealing device 144 described further below.

Siphoning the beverage 116 from the beverage reservoir 108 may involve running a siphoning line 146 from the beverage reservoir 108 to the beverage bag 102. The illustrated example siphoning line 146 includes the siphon line outlet portion 136, a siphon line inlet portion 148, and a siphon line main tube portion 150. In some examples, the siphon line outlet portion 136 and the siphon line inlet portion 148 each include a rigid plastic tube. In some examples, siphon line main tube portion 150 includes a flexible plastic tube. In the illustrated example, the siphon line outlet portion 136 and the siphon line inlet portion 148 are separate from the siphon line main tube portion 150, and are sealingly joined to the siphon line main tube portion 150 to form the siphoning line 146.

The illustrated siphon line outlet portion 136 is shaped to extend through the dispensing passage 124. The siphon line outlet portion 136 may be extended into the beverage bag 102 through the dispensing spout 104. In the illustrated example, the siphon line inlet portion 148 is extended into the beverage 116 in the beverage reservoir 108 and the siphon line main tube portion 150 joins the siphon line inlet portion 148 and siphon line outlet portion 136 to facilitate siphoning from the beverage reservoir 108 to the beverage bag.

The beverage bag 102 may be made of a relatively thick, stiff plastic material. In some examples, internal pressure is required to expand the beverage bag 102 into the corners of the container housing. The beverage bag 102 may be an oxygen barrier bag. The beverage bag 102 may include a 2-ply oxygen barrier bag, such as to keep the wine fresh. In some examples, the beverage bag 102 is an oxygen barrier bag with a dispensing spout forming a rigid mouth formed of rigid plastic and provided to receive a removable dispensing tap, such as oxygen barrier bags commonly used by home wine makers. An oxygen barrier bag may facilitate long term storage of the beverage 116 in the beverage bag 102.

The illustrated dispensing spout 104 may be sealed around the siphon line outlet portion 136. Sealing the dispensing spout 104 around the siphon line outlet portion 136 prevents pressure release through the dispensing spout 104 around the siphon line outlet portion 136. The sealing device 144 may be used to seal around the siphon line, such as by closing the dispensing spout 104 around the siphon line outlet portion 136.

In some examples, a pump, such as a manual pump, may be used to initiate a siphoning flow. For example, Applicant's Auto-Siphon™ pump may be secured to the siphon line inlet portion 148 and used to initiate a siphoning flow at the siphon line inlet portion 148. Initiating a siphoning flow with a pump may prevent the need to initiate a siphoning flow by sucking on the siphon line outlet portion 136 prior to inserting the siphon line outlet portion 136 into the dispensing spout 104.

In the illustrated example of FIG. 1, the dispensing spout 104 is sealed around the siphon line outlet portion 136 to prevent pressure release around the siphon line outlet portion 136 and to hold pressure in the beverage bag 102. Sealing facilitates using siphoning action to expand the beverage bag 102. While the dispensing spout 104 is sealed around the siphon line outlet portion 136 the beverage 116 may be siphoned from the beverage reservoir 108 into the beverage bag 102 through the siphon line outlet portion 136 to expand the beverage bag 102.

The pressure from siphoning while the dispensing spout 104 is sealed around the siphon line outlet portion 136 may be sufficient to expand the beverage bag 102 to fill the inner dimensions of the rigid container housing 120. In some examples, the inner dimensions of the rigid container housing 120 are delimited by a simple structure for supporting the dispensing spout. In some examples, the inner dimensions of the rigid container housing 120 are delimited by the interior surfaces of the walls of the housing 122 and/or an enclosed chamber.

Figure 8:
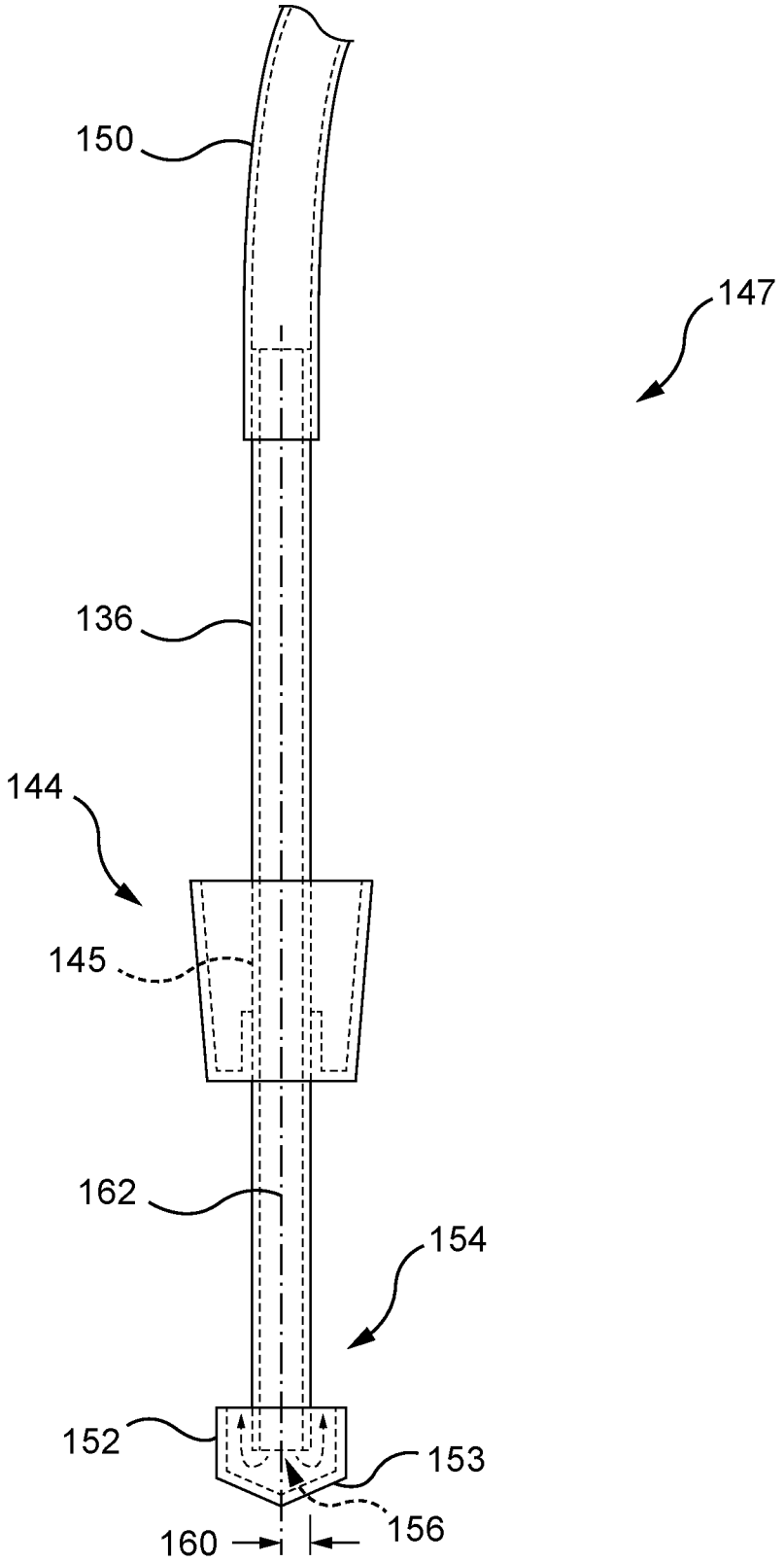
FIG. 8 is an expanded cross sectional view of a siphon line outlet portion of the beverage siphoning apparatus of FIG. 1.

Referring to FIG. 8, illustrated is the siphoning apparatus 147. The siphoning apparatus 147 includes a siphon line outlet portion 136 and a sealing device 144. In the illustrated example the sealing device 144 is a tapered stopper. The illustrated tapered stopper includes bore 145 shaped for receiving the outlet portion 136 of the siphon line. The tapered stopper sealing device 144 is shaped to fit into a circular dispensing spout 104 to close the circular dispensing spout 104 around the siphon line outlet portion. In some examples, the sealing device 144 is formed of elastomeric material. In some examples, the siphon line outlet portion 136 is a rigid plastic tube. In some examples, the siphon line outlet portion 136 is a rigid plastic tube to extend through the bore 145 through the tapered stopper.

In the illustrated example, a spacer tip 152 is securable to an end 154 of the siphon line outlet portion 136 adjacent an outlet opening 156 of the siphon line outlet portion 136. The spacer tip 152 is shaped to fit through the dispensing passage 124 while secured to the end of the siphon line outlet portion 136. The spacer tip 152 may prevent a wall of the beverage bag 102 from blocking the outlet opening 156. In some examples, the spacer tip 152 includes a rigid plastic. In some examples, the spacer tip 152 extends beyond the outlet opening 156 to hold the wall of the beverage bag 102 away from the outlet opening 156.

In the illustrated example, the spacer tip 152 is also a flow diverter to direct a flow of the beverage laterally upon exiting the outlet opening 156. A flow diverter assists in keeping the wall of the beverage bag 102 from blocking the outlet opening 156 by redirecting the flow of the beverage. In the illustrated example, the spacer tip 152 includes a spaced cover 153 to divert flow and to hold the wall of the beverage bag 102 away from the outlet opening 156.

Referring again to FIG. 1, the siphon line outlet portion 136 is shaped to form an air pocket 158 in the beverage bag 102 adjacent the dispensing spout 104 when extending into the beverage bag 102. In some examples, the air pocket 158 assists in preventing the siphoning operation from overfilling the beverage bag 102. The siphoning operation may fill the beverage bag 102 until the pressure in the beverage bag 102 is sufficient to stop the siphoning operation. In some cases, the air pocket 158 keeps the siphoning operation from completely filling the beverage bag 102, so that when the siphon line outlet portion 136 is removed from the beverage bag 102 an open volume of the beverage bag 102 is unfilled. In some examples, when the siphoning pressure available from the reservoir equalizes with the pressure inside the beverage bag 102 as the beverage bag 102 conforms to the internal dimensions of the rigid container, the flow of beverage from the reservoir stops automatically.

The beverage bag 102 may be somewhat elastic, and may relax to a smaller total volume once the siphon line outlet portion 136 is removed after a siphoning operation and pressure is released. In some examples, if the beverage bag 102 was fully filled during the siphoning operation the beverage bag 102 would overflow when the siphon line outlet portion 136 is removed and the beverage bag relaxes to a smaller total volume.

The air pocket 158 may keep the open volume unfilled to prevent overfilling. In some examples, once the siphon line outlet portion 136 is removed, the beverage bag 102 is topped up by pouring a further quantity of the beverage through the opened dispensing spout 104.

Once the siphon line outlet portion 136 is removed after the siphoning action has been used to expand the beverage bag 102, the beverage bag 102 may remain expanded sufficiently expanded to allow at least part of the open volume to remain available to be filled by pouring the beverage 116 through the dispensing spout 104.

In some examples, the siphon line outlet portion 136 is inserted at least 2.5 cm into the beverage bag 102 in forming the air pocket 158. In some examples, the siphon line outlet portion 136 is inserted about 8.5 cm into the beverage bag 102 in forming the air pocket 158. Inserting the siphon line outlet portion 136 further into the container may result in a larger air pocket 158. The siphon line outlet portion 136 may be inserted into the beverage bag 102 far enough to leave an unfilled volume when the siphon line outlet portion 136 is withdrawn. In some examples, the siphon line outlet portion 136 is inserted into the beverage bag 102 to an extent that a small unfilled volume remains when the siphon line outlet portion 136 is withdrawn so that a user can top up the unfilled volume in a few seconds of pouring from the siphon line.

Referring again to FIG. 8, the illustrated spacer tip 152 facilitates forming the air pocket. The spacer tip 152 extends laterally out beyond the walls of the siphon line outlet portion 136 from a flow axis 162 (i.e., past the radial extent 160 of the siphon line). The spacer tip assists in forming an air pocket by pushing apart a wall or walls of the beverage bag 102 as the siphon line outlet portion 136 is inserted.

Referring now to FIG. 3, after the beverage bag 102 is expanded, the siphon line outlet portion 136 may be withdrawn from the beverage bag 102 and the dispensing passage 124 blocked with a dispensing tap 164. The dispensing tap 164 may govern fluid flow through the dispensing passage 124. A user may open the dispensing tap to allow fluid to flow out of the beverage bag 102 and close the dispensing tap to stop the flow of fluid. A floor of the container may be sloped towards the dispensing tap to direct fluid towards the dispensing tap, such as to facilitate further fluid flow when the beverage bag 102 is nearly empty.

The consumer can dispense desired quantities of the beverage 116 from the beverage container 118 through the dispensing spout 104. In some examples, the beverage container 118 holds about 1 to 10 liters of the beverage.

Figure 9:
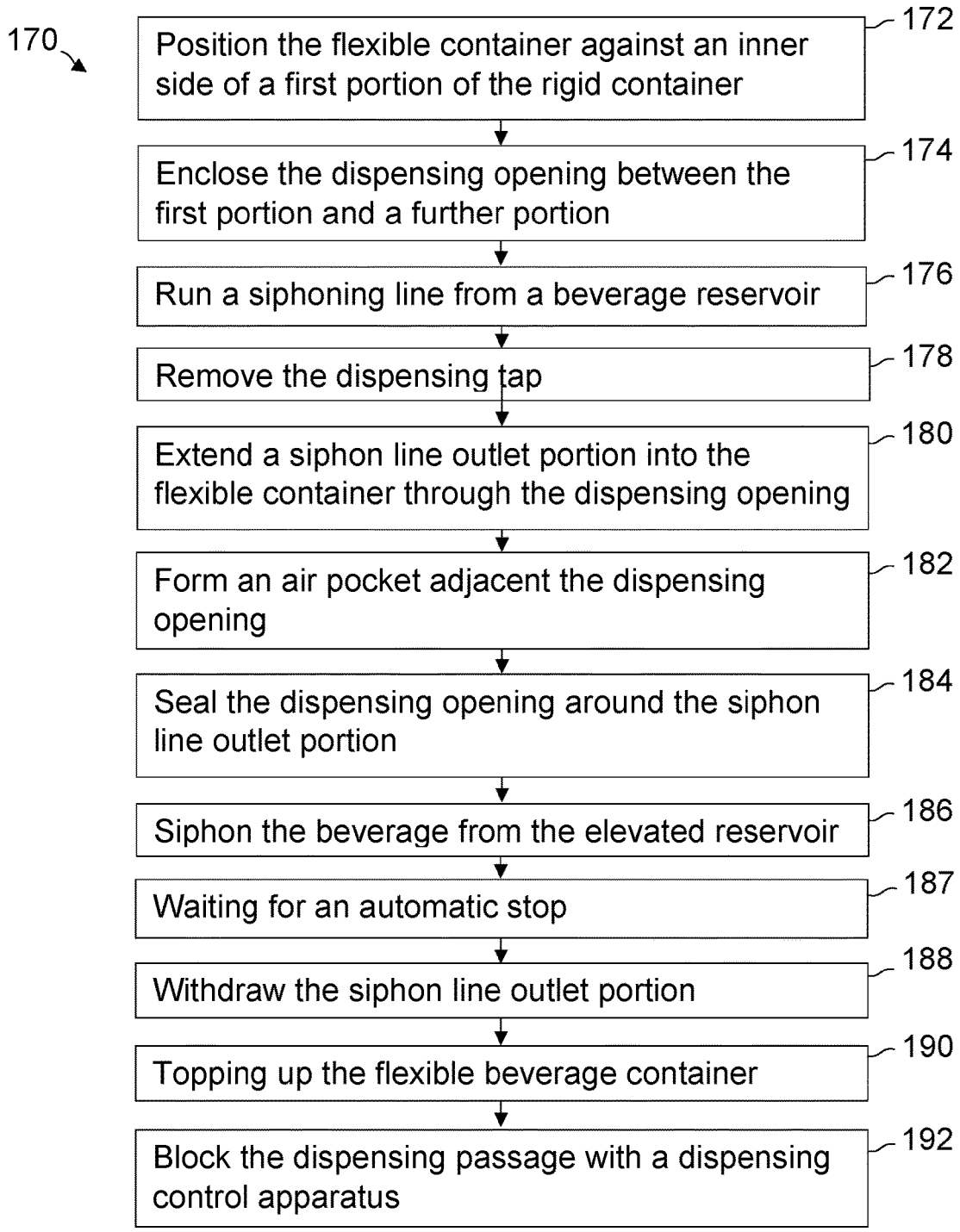
FIG. 9 is a flow chart of a method of filling a beverage bag with a beverage.

Referring to FIG. 9, a method 170 of filling a beverage bag with a beverage may include positioning 172 the beverage bag against an inner side of a first portion of the rigid container housing. The method 170 may include positioning 174 at least one further portion of the rigid container housing over the beverage bag and securing the at least one further portion to the first portion to assemble the rigid container housing and enclose the dispensing spout therebetween to hold the dispensing spout.

The method 170 includes running 176 a siphoning line from a beverage reservoir to the beverage bag and removing 178 the dispensing tap from the beverage bag. The method 170 includes extending 180 a siphon line outlet portion of the siphoning line into the beverage bag through the dispensing passage.

The method 170 may include forming 182 an air pocket within the beverage bag adjacent the dispensing spout by extending the siphon line outlet portion into the beverage bag through the dispensing passage. The method 170 includes sealing 184 the dispensing spout around the siphon line outlet portion to prevent pressure release through the dispensing spout around the siphon line outlet portion.

The method 170 includes siphoning 186 the beverage, while the dispensing spout is sealed around the siphon line outlet portion, from the beverage reservoir into the beverage bag through the siphon line outlet portion to expand the beverage bag into the corners of the container housing so as to fill the inner dimensions of the rigid container housing. In some examples, the method 170 includes initiating a siphoning flow from the reservoir into the beverage bag after sealing 184 the dispensing spout around the siphon line outlet portion. For example, a pump, such as Applicant's Auto-Siphon™ manual pump, may be used to initiate a siphoning flow after sealing 184 the dispensing spout around the siphon line outlet portion.

The method 170 may include withdrawing 188 the siphon line outlet portion from the beverage bag once the beverage bag is expanded. In some examples, the method 170 includes waiting 187 for the siphoning flow to automatically stop before withdrawing 188 the siphon line outlet portion. For example, the siphoning flow may automatically stop when the siphoning pressure available from the reservoir equalizes with the pressure inside the beverage bag as the beverage bag conforms to the internal dimensions of the rigid container.

The method 170 may include topping up 190 the beverage bag with beverage after withdrawing the siphon line outlet portion from the beverage bag, and blocking 192 the dispensing passage with a dispensing tap.

The present invention has been described here by way of example only. Various modification and variations may be made to these examples without departing from the scope of the invention, which is limited only by the appended claims.

The invention claimed is:

1. A method of filling a beverage bag with a beverage, comprising:

running a siphoning line from a beverage reservoir to the beverage bag, wherein the beverage bag is part of a beverage container that also includes a rigid container housing supporting a dispensing spout of the beverage bag, the dispensing spout forming a dispensing passage from an interior of the beverage bag to an exterior of the beverage container for dispensing a content of the beverage bag;

removing a dispensing tap from the beverage bag;

extending a siphon line outlet portion of the siphoning line into the beverage bag through the dispensing passage;

sealing the dispensing spout around the siphon line outlet portion to prevent pressure release through the dispensing spout around the siphon line outlet portion;

siphoning the beverage, while the dispensing spout is sealed around the siphon line outlet portion, from the beverage reservoir into the beverage bag through the siphon line outlet portion to expand the beverage bag to fill a set of inner dimensions of the rigid container housing; and withdrawing the siphon line outlet portion from the beverage bag once the beverage bag is expanded.

2. The method of claim 1, further comprising forming an air pocket within the beverage bag adjacent the dispensing spout by extending the siphon line outlet portion into the beverage bag through the dispensing passage.

3. The method of claim 1, wherein the rigid container housing includes a housing forming an enclosed chamber, and the beverage bag is received in the enclosed chamber with the dispensing passage extending out of the enclosed chamber.

4. The method of claim 1, further comprising, after withdrawing the siphon line outlet portion from the beverage bag, blocking the dispensing passage with the dispensing tap.

5. The method of claim 1, wherein the beverage is wine and the beverage bag includes an oxygen barrier bag.

6. The method of claim 1, further comprising, ahead of running the siphoning line from the beverage reservoir to the beverage bag:

positioning the beverage bag against an inner side of a first portion of the rigid container housing; and positioning at least one further portion of the rigid container housing over the beverage bag and securing the at least one further portion to the first portion to assemble the rigid container housing and enclose the dispensing spout therebetween to hold the dispensing spout.

7. The method of claim 1, wherein a spacer tip is included on the siphon line outlet portion adjacent an outlet opening of the siphon line outlet portion to prevent the outlet opening from being blocked by a wall of the beverage bag.

8. The method of claim 1, wherein a tapered stopper is included on the siphon line outlet portion for use in sealing the dispensing spout around the siphon line outlet portion.

9. The method of claim 1, wherein the dispensing passage extends out of a front side of the rigid container housing, and wherein the rigid container housing is rested on a back side opposite the front side while the beverage is siphoned from the beverage reservoir into the beverage bag through the siphon line outlet portion.

10. The method of claim 1, further comprising waiting for the siphoning flow to automatically stop before withdrawing the siphon line outlet portion from the beverage bag.

11. A beverage siphoning system, comprising:

a beverage container, including a rigid container housing for housing a beverage bag, the beverage bag having a dispensing spout forming a dispensing passage to an exterior of the beverage container and a dispensing tap configured to be removably fitted into the dispensing spout, wherein the rigid container housing has an opening configured for supporting the dispensing spout of the beverage bag in a fixed position relative to the opening during siphoning of a beverage into the beverage bag when the beverage bag is housed in the rigid container housing;

a siphon line having an inlet portion for receiving the beverage from a beverage reservoir and an outlet portion shaped to extend through the dispensing passage into the beverage bag and form an air pocket in the beverage bag adjacent the dispensing spout; and a sealing device shaped to close the dispensing spout, when the dispensing tap is removed from the beverage bag, to prevent pressure release through the dispensing spout around the siphon line outlet portion during the siphoning, the sealing device having a bore shaped for receiving the outlet portion of the siphon line.

12. The system of claim 11 further comprising a spacer tip securable to an end of the siphon line outlet portion adjacent an outlet opening of the siphon line outlet portion and shaped to fit through the dispensing spout while secured to the end of the siphon line outlet portion and prevent a wall of the flexible container from blocking the outlet opening.

13. The system of claim 11, wherein the rigid container housing includes a housing forming an enclosed chamber having at least one interior corner, and the beverage bag is received in the enclosed chamber with the dispensing passage extending out of the enclosed chamber.

14. The system of claim 11, wherein the sealing device includes a tapered stopper shaped to block the dispensing spout around the siphon line outlet portion.

15. The system of claim 11, wherein the rigid container housing includes a viewing window in a wall of the rigid container housing and the beverage bag is formed of a transparent material to allow the user to view a content level of a content of the beverage bag through the viewing window and through the beverage bag.

16. The system of claim 15, wherein the wall of the viewing window is on a bottom side of the rigid container housing.

17. The system of claim 11, wherein the rigid container housing includes at least two portions releasably connected around the beverage bag to hold the beverage bag in the rigid container housing.

18. The system of claim 17, wherein the at least two portions are releasably connected by snap-fit connectors.

19. A beverage siphoning apparatus for siphoning a beverage into a beverage container comprising a rigid container housing for housing a beverage bag, the beverage bag having a dispensing spout forming a dispensing passage to an exterior of the beverage container and a dispensing tap configured to be removably fitted into the dispensing spout, wherein the container housing has an opening configured for supporting the dispensing spout, the siphoning apparatus comprising:

a siphon line having an inlet portion for receiving a beverage from a beverage reservoir and an outlet portion shaped to extend through the dispensing passage into the beverage bag;

a spacer tip secured to an end of the siphon line outlet portion adjacent an outlet opening of the siphon line outlet portion and shaped to fit through the dispensing spout while secured to the end of the siphon line outlet portion and prevent a wall of the flexible container from blocking the outlet opening; and a sealing device shaped to close the dispensing spout, when the dispensing tap is removed from the beverage bag, to prevent pressure release through the dispensing spout around the siphon line outlet portion during siphoning, the sealing device having a bore shaped for receiving the outlet portion of the siphon line.

20. The beverage siphoning apparatus of claim 19, further comprising the rigid container housing for housing the beverage bag, the rigid container housing having the opening configured for supporting the dispensing spout with the dispensing passage extending to a housing exterior of the rigid container housing.

* * * * *